US006736624B1

(12) United States Patent
Tietze et al.

(10) Patent No.: US 6,736,624 B1
(45) Date of Patent: May 18, 2004

(54) SPINNING DEVICE FOR SPINNING MOLTEN POLYMERS AND METHOD FOR HEATING THE SPINNING DEVICE

(75) Inventors: Rainer Tietze, Nauheim (DE); Heinz-Dieter Beeck, Frankfurt am Main (DE); Thomas Gries, Frankfurt am Main (DE); Werner Mrose, Maintal (DE); Richard Prehler, Schöneck (DE)

(73) Assignee: Zimmer Aktiengesellschaft, Frankfurt am Main (DE)

( * ) Notice: Subject to any disclaimer, the term of this patent is extended or adjusted under 35 U.S.C. 154(b) by 0 days.

(21) Appl. No.: 09/979,310

(22) PCT Filed: May 2, 2000

(86) PCT No.: PCT/EP00/03974

§ 371 (c)(1),
(2), (4) Date: Nov. 20, 2001

(87) PCT Pub. No.: WO00/73544

PCT Pub. Date: Dec. 7, 2000

(30) Foreign Application Priority Data

May 29, 1999 (DE) ..... 199 24 838

(51) Int. Cl.[7] ..... D01D 5/08

(52) U.S. Cl. ..... 425/72.2; 425/192 S; 425/378.2; 425/382.2; 425/464

(58) Field of Search ..... 425/72.2, 192 S, 425/378.2, 382.2, 464; 264/40.6, 176.1

(56) References Cited

U.S. PATENT DOCUMENTS 3,767,347 A * 10/1973 Landoni ..... 425/378.2
4,698,008 A * 10/1987 Lenk et al. ..... 425/192 S
5,733,586 A * 3/1998 Herwegh et al. ..... 425/192 S
5,866,050 A * 2/1999 Krauss et al. ..... 264/40.6
5,902,531 A * 5/1999 Berger et al. ..... 264/103
5,922,362 A * 7/1999 Schippers et al. ..... 425/72.2
6,083,432 A * 7/2000 Schafer ..... 264/39

FOREIGN PATENT DOCUMENTS

DE 1964051 * 9/1971
DE 33 31 543 A1 3/1984
EP 0 860 524 A2 8/1998
WO WO 92/13119 8/1992

OTHER PUBLICATIONS

Patent Abstracts of Japan, 63100618, Filed Apr. 22, 1988, Oct., 1989.
Patent Abstracts of Japan, 06218539, Filed Sep. 13, 1994, Mar. 1996.
Patent Abstracts of Japan, 54041705, Filed May 5, 1979, Nov. 1980.

* cited by examiner

*Primary Examiner*—Robert Davis
*Assistant Examiner*—Joseph S Del Sole
(74) *Attorney, Agent, or Firm*—Herbert Dubno

(57) ABSTRACT

The invention relates to a spinning device in which liquid polymer is guided through a polymer line with a first heating jacket to a spinning pump with a second heating jacket. From said spinning pump, the polymer is transported through several lines to spinning packets and extruded through spinnerts to form filaments. The lines that are connected downstream of the spinning pump, the spinning packets and the spinnerets are located in at least one spinning housing through which heating fluid flows. There is a distance of 5 mm between the spinning housing through which the heating fluid flows and the first and second heating jackets and the spinning pump, to obtain thermal decoupling. According to a method for heating the spinning device, vaporous heating fluid is guided out of a first reservoir into the spinning housing, and heating fluid is guided out of a second reservoir into the first and/or second heating jacket. The temperature of the heating fluid that is supplied to the spinning housing is 10 to 40° C. higher than the temperature of the heating fluid that is supplied to the first and/or second heating jacket.

3 Claims, 3 Drawing Sheets

SPINNING DEVICE FOR SPINNING MOLTEN POLYMERS AND METHOD FOR HEATING THE SPINNING DEVICE

CROSS REFERENCE TO RELATED APPLICATIONS

This application is a national stage of PCT/EP00/03974 filed 2 May 2000 and is based upon German national application 199 24 838.9 of 29 May 1999 under the International Convention.

FIELD OF THE INVENTION

The invention relates to an apparatus for spinning liquid polymers to produce polymer filaments, whereby the liquid polymer flows through a polymer duct with a first heating jacket to a spinning pump with a second heating jacket, which displaces the polymer through a plurality of conduits to spinning packets and extrudes the polymer through the spinneret downwardly to form filaments, whereby the conduits downstream of the spinning pump, the spinning packets and the spinneret are located in at least one spinning housing that is traversed by heating fluid. The invention also relates to a method of heating the spinning apparatus.

BACKGROUND OF THE INVENTION

Spinning apparatuses with heating of this type are known from DE 196 24 946 A1 and DE 198 09 495 A1. The different. heated parts of the apparatus are maintained, in this case, approximately at the same temperature level which is prescribed by the heating fluid used.

OBJECT OF THE INVENTION

The invention has as its object to maintain the molten polymer upstream of the spinning housing, independently of the temperature in the spinning housing, at the lowest possible temperature so as to exclude possible damage to the polymer.

SUMMARY OF THE INVENTION

According to the invention the object is attained in the spinning apparatus described at the outset in that between the spinning housing traversed by the heating fluid on the one hand and on the other hand the first and second heating jackets and the spinning pump, there is a spacing of at least 5 mm and preferably at least 10 mm. This spacing ensures a thermal decoupling and ensures that the polymer will be held at the lowest possible temperature as long as it has still not entered the heated spinning housing. In this manner deterioration in the flowing polymer, which can arise as a result of relatively high temperatures, can be completely or largely excluded.

In addition to a spatial separation of the heated spinning housing, it is advantageous in accordance with a further feature of the invention to effect the heating of the spinning apparatus in a suitable manner. For this purpose heating fluid in the form of a vapor is conducted from a first supply vessel into the spinning housing and heating fluid from the later is discharged, heating fluid from a second supply vessel is fed through the first and/or second heating jackets, and care is taken such that the temperature of the heating fluid in a vapor state fed to the spinning housing is 10 to 40° C. higher than the temperature of the heating fluid that is fed to the first and/or second heating jackets.

The heating fluids can be prepared with different temperatures in two supply vessels. As a heating fluid, for example Diphyl, is suitable and is commercially available in various modifications whereby the same heating fluid or different heating fluids can be prepared in the two supply vessels. To maintain the temperature difference on the one hand in the region of the spinning pump and the polymer feed conduits and on the other hand in the spinning housing, the region between the spinning housing on the one hand and the first and second heating jackets on the other hand can be maintained free from the heating fluid. As a result the desired temperature difference can be maintained during operation.

The supply of heating fluid to the first and second heating jackets can be coupled in many cases; thus it is possible to feed the heating fluid coming from the supply vessel initially through the first heating jacket and then through the second heating jacket or in the reverse order. Usually the first and second heating jackets are heated with liquid heating fluid. It is further possible to operate the first and second heating jackets also with separate heating circulations.

As the polymer one can use for example polyester or polyamide. The liquid polymer usually derives from an extruder for the melting of polymer granules but, however, can be from a polymerization reactor. The polymer is admitted to the region of the spinning pump at a temperature of 270 to 300° C. and is extruded through the spinneret with a temperature of about 295 to 320° C.

BRIEF DESCRIPTION OF THE DRAWING

Various possible embodiments of the apparatus and method are detailed with the aid of the drawing wherein.

SPECIFIC DESCRIPTION

Figure 1:
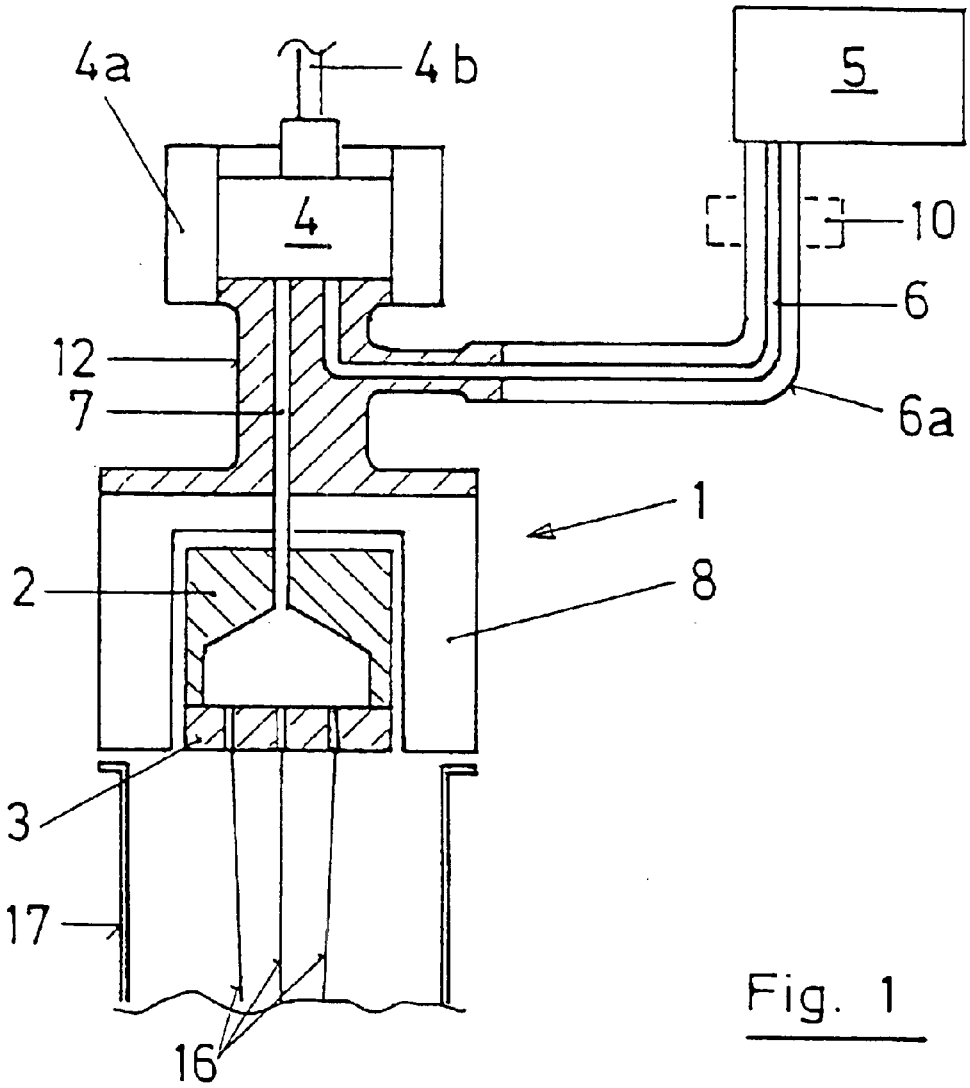
FIG. 1 is a schematic illustration of the spinning device.

The main parts of the spinning device according to FIG. 1 are the spinning housing 1 which is also designated as a spinning beam, with a plurality of spinning packets 2 and spinnerets 3, the spinning pump 4 and the extruder or polymerization reactor 5 from which the liquid polymer flows through a duct 6 to the pump 4. From there, the polymer is fed through outlet conduits 7 of which only one has been illustrated, into spinning packets 2. The spinning housing 1 has a heating chamber 8 which is heated in the usual manner with a heating fluid in the form of vapor. The heating jacket and also the heating chamber 8 are provided with inlet and outlet ducts for heating fluid; in FIGS. 2 and 3 these are indicated in greater detail. The outlet conduits 7 pass through the support 12 forming the region maintained free from the heating fluid mentioned earlier.

In the duct 6 a pump 10 can be provided when the polymer does not come from an extruder but derives from a polymerization reactor 5. The heating of the spinning housing 1, the region of the spinning pump 4 and the duct 6 can be effected in different ways largely independent from one another since heating fluid in a first supply vessel 14 and a second supply vessel 15 can be prepared with different temperatures (compare FIGS. 2 and 3).

In a first variant (compare FIG. 2), which is especially suitable for polyester, the liquid polymer derives from a polymerization reactor 5 at about 278° C. Via the pump 10 (for example a gear pump), the melt is fed through the feed duct 6 initially to the spinning pump 4 and from there to the spinneret 3 where the melt is extruded downwardly in the form of numerous filaments 16. In a manner known per se and not illustrated in greater detail (compare also FIG. 1), the filaments travel through a shaft 17 downwardly to a coiling device. Heating fluid in the form of a vapor, whose temperature is slightly above the boiling point, derives from the first vessel 14 and flows through the conduit 9 into the heating chamber 8 and then through the conduit 18 into the second heating jacket 4*a*. From there the vapor flows through the conduit 19 into a condenser 20. Condensed heating fluid flows through the conduit 21 back into the first heating vessel 14 where it is reheated. The temperature in the conduit 9 usually lies in the range of 280 to 330° C. At the same time heating fluid from the second supply vessel 15 which is preferably liquid, is fed through the conduit 23 to the first heating jacket 6*a* and flows by the return conduit 24 back into the second supply vessel 15.

Figure 3:
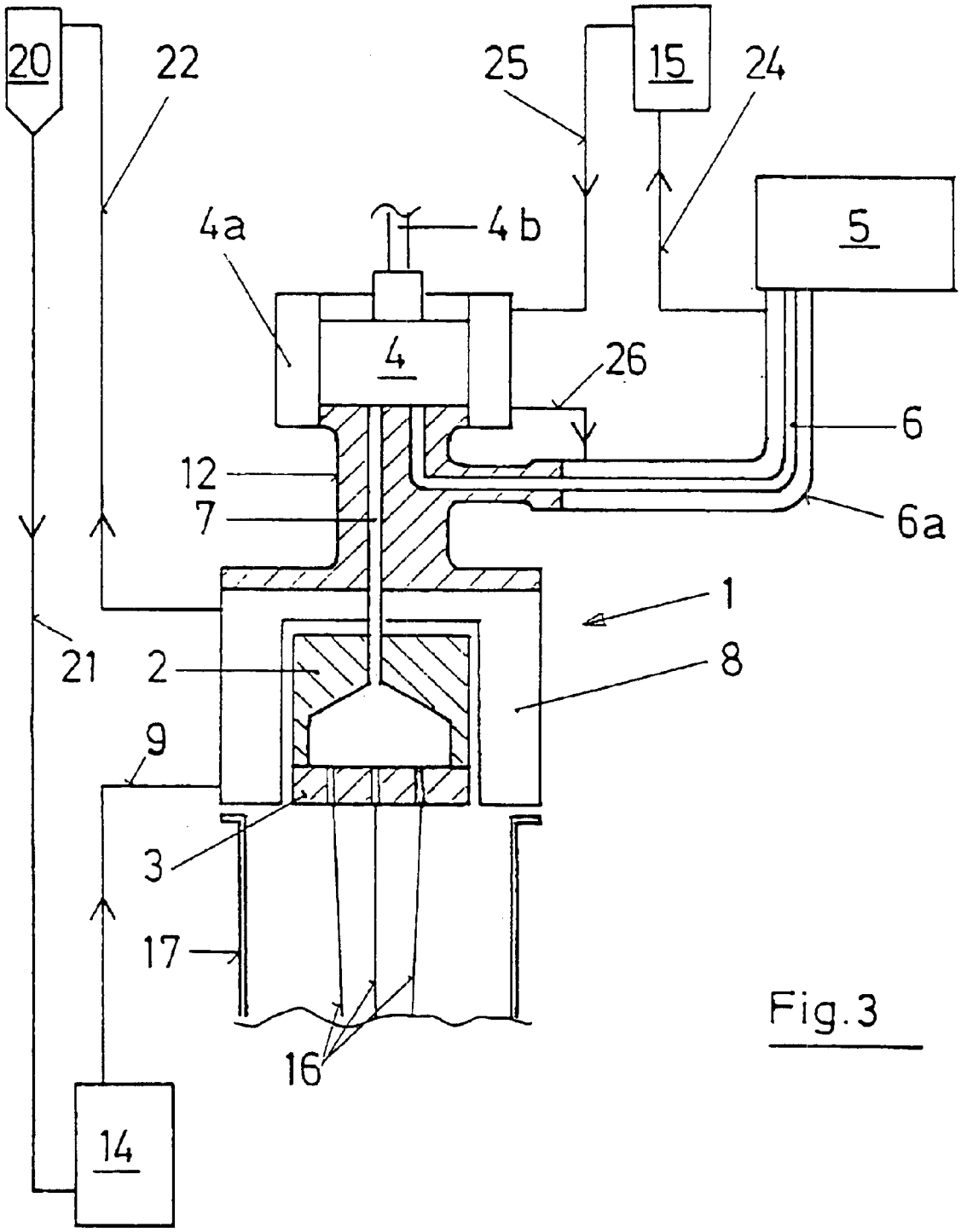
FIG. 3 is another section showing a second variant of the supply of heating fluids to the spinning device.

A further heating variant is detailed with the aid of FIG. 3. Here the polymer derives from an extruder 5 in which preferably polyester and possibly also polyamide is processed. A heating medium in the form of vapor is fed through the conduit 9 into the heating chamber 8 and from there through the conduit 22 directly into the condenser 20 and from there back. From the second supply vessel 15 comes heating fluid which is preferably liquid and traverses the conduit 25 to enter initially the second heating jacket (4*a*) and from there flows through the conduit 26 into the first heating jacket 6*a*. The return line is provided by the conduit 24.

EXAMPLE

Polyester is spun and Diphyl is used as the heating fluid both in the first supply vessel 14 as well as in the second supply vessel 15. The distance between the heated spinning housing 1 and the cold region of the two heating jackets and the spinning pump 4 amounts to 20 mm.

Eample 1

Figure 2:
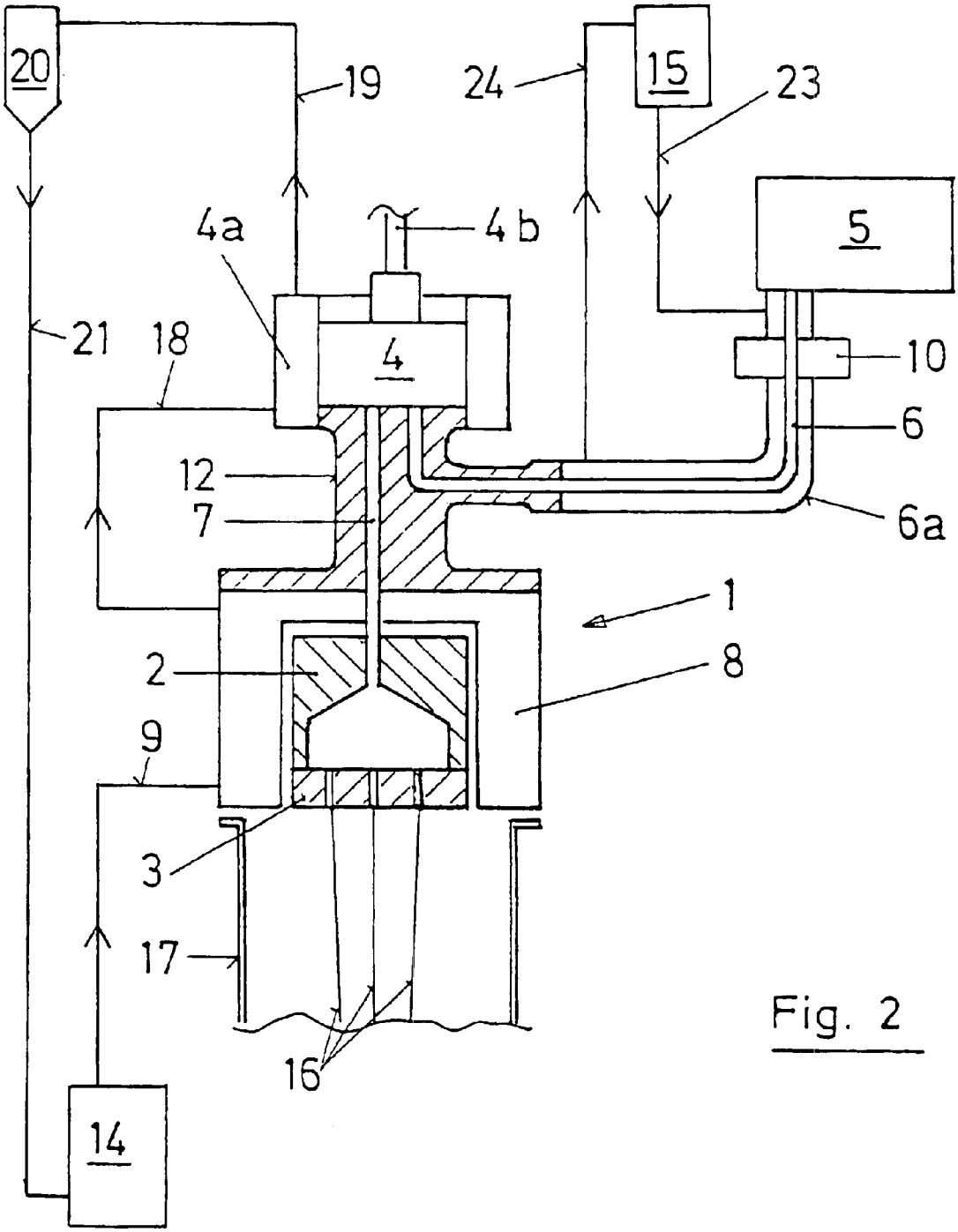
FIG. 2 is a similar cross sectional view showing one variant for the supply of heating fluid.

The operation is in accordance with FIG. 2 whereby the polymer derives from the reactor 5 at a temperature of 278° C. The heating fluid from conduit 23 has a temperature of 280° C. The temperature in the region of the spinneret 3 amounts to 310° C. and the heating fluid vapor has the same temperature in the conduit 9 and 18. In the outlet conduit 7 the temperature amounts of 196° . The temperature increase in the polymer resulting from the pressure increase by the spinning pump 4 amounts to 14° C. and the pump 10 raises the temperature of the polymer by 20° C.

Eample 2

The operation is in accordance with FIG. 3 whereby the polymer derives from the extruder 5 at 295° C., the temperature being 310° C. in the region of the spinneret 3. The temperature increase in the polymer resulting from the pressure increase by the spinning pump 4 amounts to 14° C. The heating fluid in the conduit 9 has a temperature of 315° C. and in the conduits 25 and 26 of 298° C.

What is claimed is:

1. An apparatus for the spinning of liquid polymer to produce polymer filaments where the liquid polymer flows through a polymer duct with a first heating jacket to a spinning pump with a second heating jacket, which displaces the polymer through a plurality of conduits to spinning packets and which is then extruded through spinnerets downwardly to form filaments, whereby the conduits downstream of the spinning pump, the spinning packets and the spinnerets are disposed in at least one spinning housing which is traversed by a heating fluid in the form of a vapor, a distance of at least 5 mm being provided between the spinning housing traversed by the heating fluid on the one hand and the first and second heating jackets and the spinning pump on the other hand, a heating fluid from a second supply being admitted into the first heating jacket, and the temperature of the heating fluid in the form of a vapor supplied to the spinning housing is 10 to 40° C. higher than the temperature of the heating fluid that is fed to the first heating jacket, the second heating jacket, which surrounds the spinning pump, being fed with heating fluid from the spinning housing.

2. A method of heating a spinning apparatus comprising the steps of:

(a) passing a liquid polymer flow through a polymer duct having a first heating jacket to a spinning pump having a second heating jacket and from said spinning pump into a housing containing at least one spinning packet provided with a spinneret and a conduit delivering said liquid polymer flow to said spinning packet;

(b) passing at least one heating fluid through said first and second jackets and through said housing;

(c) maintaining a spacing between said housing and an assembly consisting of said first and second heating jackets and said spinning pump of at least 5 mm;

(d) providing the heating fluid supplied to said housing as a vapor and at a temperature 10 to 40° C. above the temperature of heating fluid supplied to said first heating jacket and said second heating jacket; and (e) feeding heating fluid from said housing through said second heating jacket.

3. The method defined in claim 2 wherein the heating fluid provided to said housing is supplied at a temperature in the range of 280° C. to 330° C.

* * * * *